US008286305B2

(12) United States Patent
Singleton

(10) Patent No.: US 8,286,305 B2
(45) Date of Patent: Oct. 16, 2012

(54) GATE HINGE

(76) Inventor: Gareth P. Singleton, Allansford (AU)

( * ) Notice: Subject to any disclaimer, the term of this patent is extended or adjusted under 35 U.S.C. 154(b) by 480 days.

(21) Appl. No.: 12/284,981

(22) Filed: Sep. 26, 2008

(65) Prior Publication Data

US 2010/0077663 A1 Apr. 1, 2010

(51) Int. Cl.
*E05D 5/02* (2006.01)

(52) U.S. Cl. ..... 16/253; 16/86.1

(58) Field of Classification Search ..... 16/253, 16/252, 86.1, 86.2, 382; 49/381, 386, 394, 49/503; 248/227.3, 229.22, 218.4, 231.41, 248/219.1, 229.1, 229.12
See application file for complete search history.

(56) References Cited

U.S. PATENT DOCUMENTS

| | | | | | |
|---|---|---|---|---|---|
| 250,916 | A * | 12/1881 | Hendeerson | 16/235 |
| 1,423,321 | A * | 7/1922 | Hacker | 16/248 |
| 2,592,722 | A * | 4/1952 | Noll | 160/328 |
| 2,651,806 | A * | 9/1953 | Thompson | 16/253 |
| 2,659,168 | A * | 11/1953 | Kaplan | 49/381 |
| 3,107,390 | A * | 10/1963 | Shelton | 16/224 |
| 3,811,149 | A * | 5/1974 | Griffin | 16/240 |
| 4,595,165 | A * | 6/1986 | Klingensmith et al. | 248/539 |
| 4,729,149 | A * | 3/1988 | Brunkan | 16/252 |
| 6,073,396 | A * | 6/2000 | Kietzmann | 49/381 |
| 6,768,474 | B2 * | 7/2004 | Hunt | 343/892 |

OTHER PUBLICATIONS

He-man Hinge Pty Ltd website, www.hemanhinge.com visited on Apr. 30, 2012.
Merriam-Webster Online Dictionary, www.merriam-webster.com/dictionary/concave, visited on Apr. 30, 2012.

* cited by examiner

*Primary Examiner* — Chuck Y. Mah
(74) *Attorney, Agent, or Firm* — TraskBritt

(57) ABSTRACT

There is described a hinge element (16), (18) for pivotally mounting a gate (14) to a fence post (12) comprising: a plurality of rods (20), (30) configured to pass at least partially through the post (12) so as to be securable thereto. A mounting member (21), (32) is attachable to an end of one or more of the rods (20), (30) so as to project beyond the post (12). The mounting member (21), (32) being configured to engage with the gate (14) so as to secure the gate (14) with respect to the post (12). One or more plates (26), (34) is slidingly receivable on the rods (20), (30) and positionable so as to abut with a surface of the post (12) when the rods (20), (30) are secured to the post (12).

14 Claims, 6 Drawing Sheets

GATE HINGE

FIELD OF INVENTION

This invention relates generally to a system and apparatus for mounting a gate to a post and, in particular, to a system and apparatus for hingedly mounting a gate to a post.

BACKGROUND OF THE INVENTION

Fences and various other types of physical barriers have long been employed to enclose a space so as to control access to and from that space. In the management of livestock, fencing systems of various types have long been employed to great success in retaining and controlling livestock movement within a paddock, field, or the like.

In order to control access to and from such a confined space, it is necessary to provide a gating system in the fence. Conventional farming gating systems employ sturdy timber posts spaced apart so as to receive a gate therebetween. The gate is typically constructed from timber or metal and is hung to one of the posts so as to be movable in a pivotal manner between an open and a closed position. A variety of mounting systems have been employed to provide such pivotal movement between the gate and the post.

Generally, gates have been mounted to a post by way of upper and lower mounting members. Upper and lower mounting members have taken a variety of forms, with earlier systems employing saddles or brackets to mount the gate to the post at an upper and lower end thereof. Such arrangements facilitate swinging or pivotal movement of the gate with respect to the post. One problem with such systems is that the bracket or saddle arrangement provides limited clearance between the gate and the post. Typically, in such systems, the gate is in direct contact with the post during the swinging motion, greatly restricting the amount of pivotal movement of the gate with respect to the post and limiting access through the gate.

In order to provide for a greater degree of pivotal movement of the gate, a variety of alternative mounting systems have been proposed. Such mounting systems generally project beyond the post such that there is greater clearance between the post and the gate. Typically, such mounting systems include an upper bracket or collar that extends about the gate to secure the upper region of the gate to the post, and a lower pintle that is typically received within an open end or gudgeon of the gate to support the gate thereon. The upper bracket and lower pintle support a side or edge of the gate enabling the gate to pivot or swing about the post. In some arrangements, the upper bracket and lower pintle are located a distance beyond the post, such that the gate does not come into contact with the post during swinging movement. This provides a greater degree of movement of the gate with respect to the post.

While such mounting systems have been successful in providing a greater degree of swinging movement of the gate with respect to the post, as they support the full weight of the gate, they have been shown to compromise the integrity of the gating system. Typically, the upper bracket or collar and the lower pintle are each mounted on an end of a single threaded shaft or rod that is received within a bore formed through the post, adjacent an upper and lower region of the post. The threaded shaft or rod is then secured to the post by way of nuts and washers fitted to the rod on either side of the post so as to be tightened about the post. One problem with such a system is that when the gate is in an open or partially open position, namely a position that is not parallel with the line of the fence, the weight of the gate acts directly on the rods in the form of a pulling force to the upper threaded rod and a pushing force to the lower threaded rod. This can cause the rods to bend over time, particularly as weight is applied to the gate in the open position. Further, these opposing forces acting through the post can create splitting of the post over time. Further, during general use of the gate, it is typical that the threaded rods become loose within the post, such that there is movement of the rods within the post. This movement can further contribute to splitting of the posts.

As the posts are generally subject to the elements, including extreme weather conditions, rain, moisture and the like can readily access the bore holes, as well as any splits created in the post by the rods. This may accelerate deterioration of the post, which can result in the gate dropping or dragging on the ground during use. Dropping or dragging gates on a fence can lead to the deterioration of the fence as well as make the gate difficult to open and close.

There is a need to provide a mounting system of mounting a gate to a post which is addressed at overcoming or at least substantially ameliorating one or more of the above-referenced problems.

The following references to and descriptions of prior proposals or products are not intended to be, and are not to be construed as, statements or admissions of common general knowledge in the art. In particular, the following prior art discussion does not relate to what is commonly or well known by the person skilled in the art, but assists in the understanding of the inventive step of the present invention of which the identification of pertinent prior art proposals is but one part.

DISCLOSURE OF INVENTION

Accordingly, in one aspect of the present invention there is provided a hinge element for pivotally mounting a gate to a fence post comprising:

- a plurality of elongate rods, each rod being configured to be received within a corresponding bore formed in the post and being securable thereto in a longitudinally adjustable manner;
- a mounting member attachable to an end of the elongate rods, the mounting element being configured to engage with at least a portion of the gate so as to facilitate pivotal movement of the gate with respect to the post; and
- one or more plates mounted on the rods, each plate being positionable so as to abut with a surface of the post when the rods are secured to the post.

In one embodiment, the one or more plates may comprise a concave surface that substantially conforms with the surface of the post when the rods are secured to the post. In one form, two plates may be received on the rods and may be positionable to abut with the surface of the post on opposing sides of the post so as to form a clamp at least partially about the post.

Each rod may have an external thread formed at least partially along a length thereof for receiving a plurality of fastening members thereon. The rods may be secured to the post by tightening the fastening members against opposing sides of the post. The plates may be positioned between the fastening members and the post such that tightening of the fastening members against opposing sides of the post may causes the plates to apply a clamping force against the post.

The plurality of rods may be received within bore holes formed through the post. The rods may be positioned within the bore holes such that opposing ends of the plurality of rods extend beyond the post.

In one embodiment, the mounting member may comprise a collar that is configured to be secured about a portion of the gate to secure the portion of the gate in position with respect to the post. The collar may be configured to be secured about an upper portion of the gate. In one form, the collar may be movable laterally with respect to the post to facilitate lateral adjustment of the gate with respect to the post.

In another embodiment, the mounting member may be a bracket having a pintle projecting from a surface thereof. The pintle may be received within a recess formed in an undersurface of the gate such that the gate is supported on the pintle and is free to pivot about the pintle.

According to a second aspect of the present invention, there is provided a hinge element for pivotally mounting a gate to a fence post comprising:

a plurality of elongate rods, each rod being configured to be received within a corresponding bore formed in the post;

a mounting element attachable to an end of the elongate rods, the mounting element being configured to engage with at least a portion of the gate so as to facilitate pivotal movement of the gate with respect to the post; and an engagement means mountable to the plurality of rods and actuable to secure the rods to the post in a longitudinally adjustable manner, the engagement means comprising a pair of plate members positionable on opposing sides of the post so as to abut with a surface of the post and a plurality of fastening members actuable to apply a force against the plate members such that the plate members apply a clamping action to the post.

According to a third aspect, there is provided a mounting assembly for hingedly mounting a gate to a fence post comprising:

an upper hinge element for securing an upper portion of the gate to the post, the upper hinge element comprising a plurality of first elongate rods, each first rod being configured to be received within a corresponding bore formed in the post and being securable thereto in a longitudinally adjustable manner; a collar attachable to an end of the first elongate rods, the collar being configured to be secured about an upper portion of the gate so as to facilitate pivotal movement of the upper portion of the gate with respect to the post; and one or more first plates mounted on the first rods, the or each first plate being positionable so as to abut with a surface of the post when the first rods are secured to the post; and a lower hinge element for securing a lower portion of the gate to the post; the lower hinge element comprising a plurality of second elongate rods, each second rod being configured to be received within a corresponding bore formed in the post and being securable thereto in a longitudinally adjustable manner; a bracket having a pintle projecting from a surface thereof is attachable to an end of the second elongate rods, the bracket being configured such that the pintle is received within a recess formed in an undersurface of the gate such that the gate is supported on the bracket and is free to pivot about the pintle to facilitate pivotal movement of the gate with respect to the post; and one or more second plates mounted on the second rods, the or each second plate being positionable so as to abut with a surface of the post when the second rods are secured to the post.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

BRIEF DESCRIPTION OF THE DRAWINGS

Preferred features of the present invention will now be described with particular reference to the accompanying drawings. However, it is to be understood that the features illustrated in and described with reference to the drawings are not to be construed as limiting on the scope of the invention. In the drawings.

DETAILED DESCRIPTION OF THE DRAWINGS

The present invention will be described below in relation to its application for use in farm and livestock fences. However, it would be appreciated that the present invention may be employed in a variety of fencing or barrier applications where gates are employed, and still fall within the spirit of the present invention.

Figure 1:
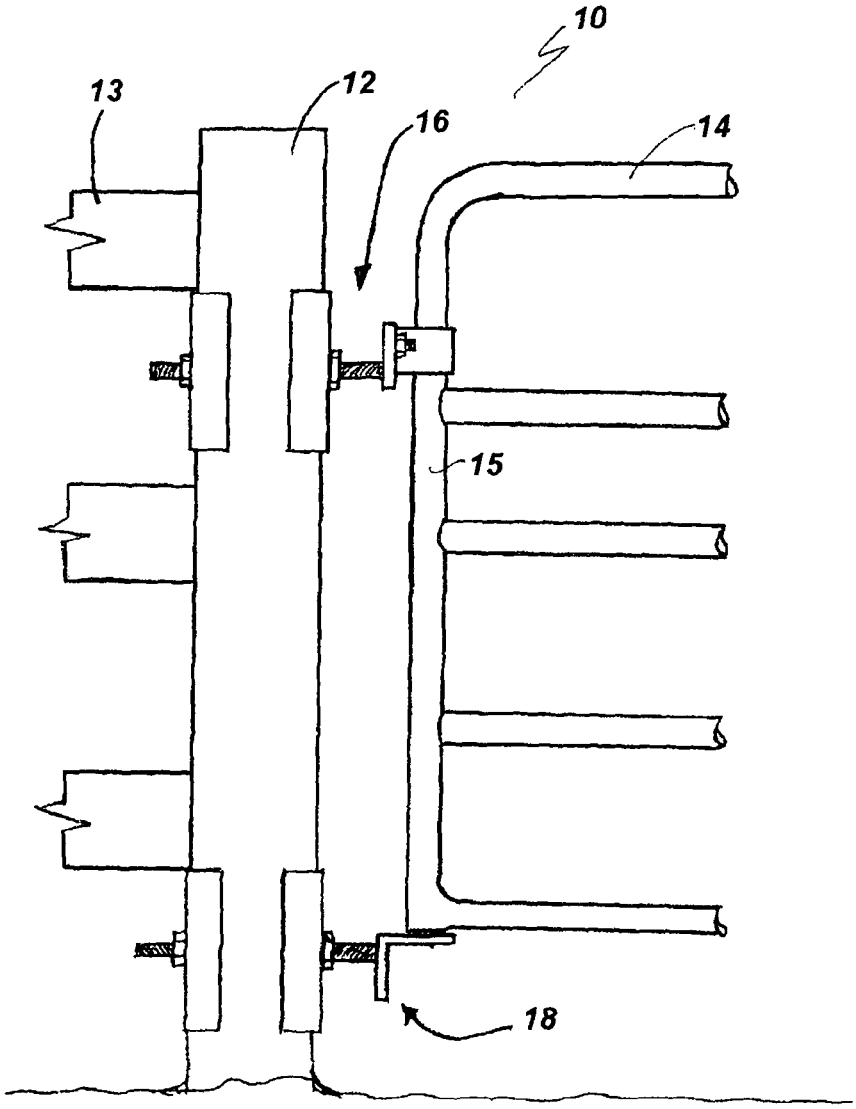
FIG. 1 is a partial side view of a gating system in accordance with one embodiment of the present invention.

Referring to FIG. 1, there is shown a gate system 10 in accordance with one embodiment of the present invention. The gate system 10 is employed in a fence 13, which may be in the form of a rail fence (as shown) or a conventional post and wire farm fence. The fence 13 comprises a post 12 that, together with a corresponding post (not shown), defines an opening in the fence 13 through which access to an enclosed space is provided.

A gate 14 is hingedly mounted to post 12 by way of an upper hinge element 16 and a lower hinge element 18. The upper hinge element 16 and lower hinge element 18 act to support the gate 14 along an end thereof, as the gate 14 pivots or swings between a closed position in general alignment with the fence 13, and an open position to permit access through the gate 14. The upper hinge element 16 and lower hinge element 18 are adjustable with respect to the post 12 so as to provide a clearance between the end support 15 of the gate 14 and the post 12.

Figure 3:
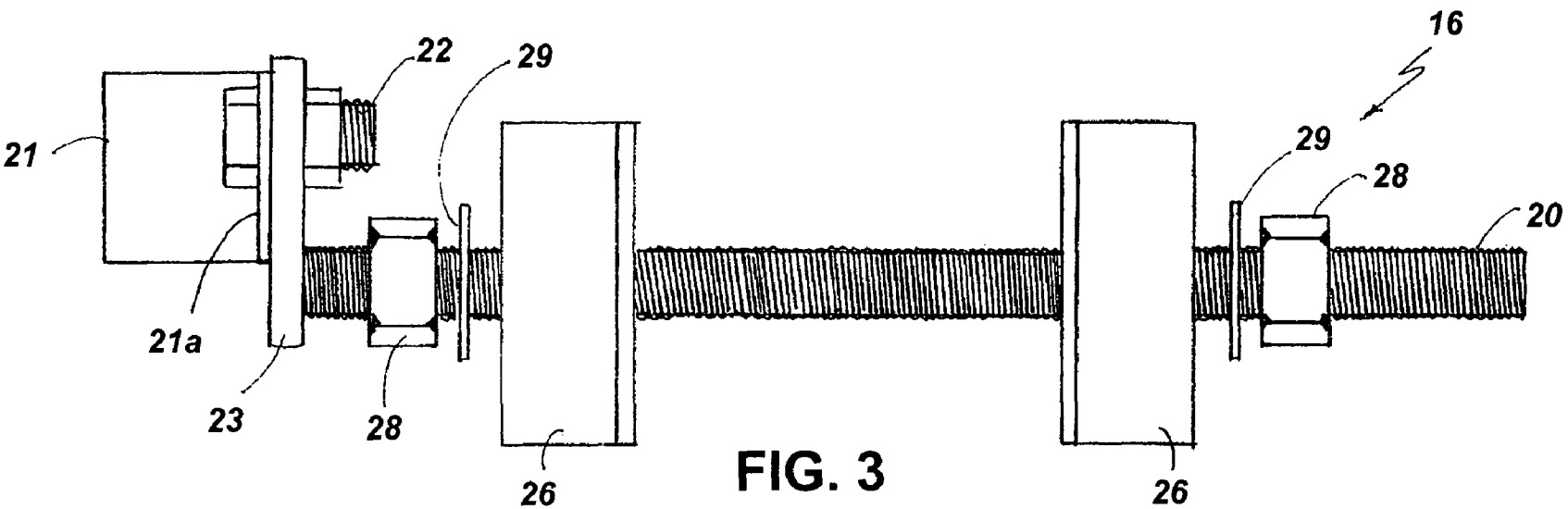
FIG. 3 is a side view of an upper hinge element of the gating system of FIG. 1, in accordance with one embodiment of the present invention.
Figure 4:
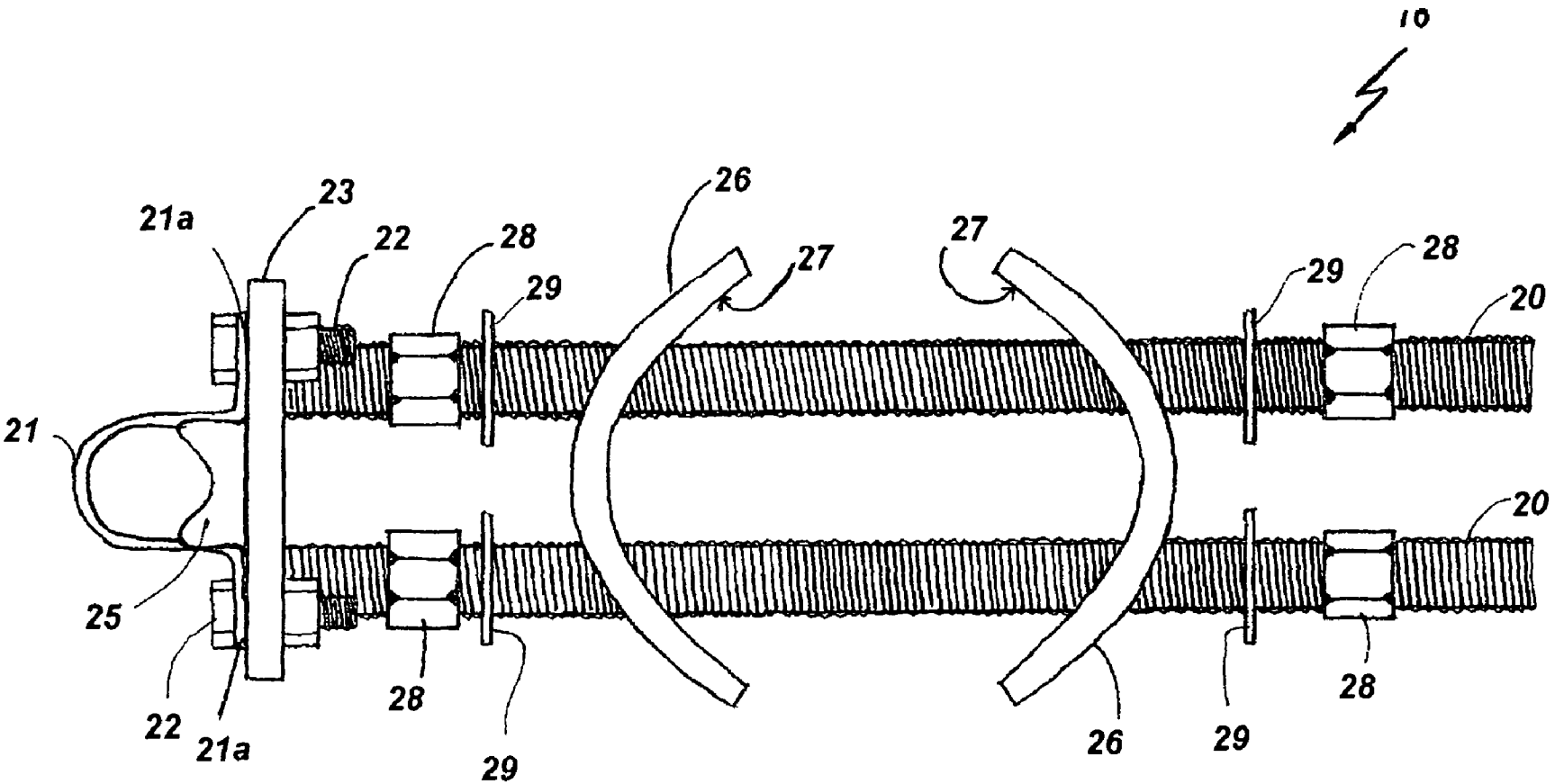
FIG. 4 is a top view of the upper hinge element of FIG. 3.
Figure 6:
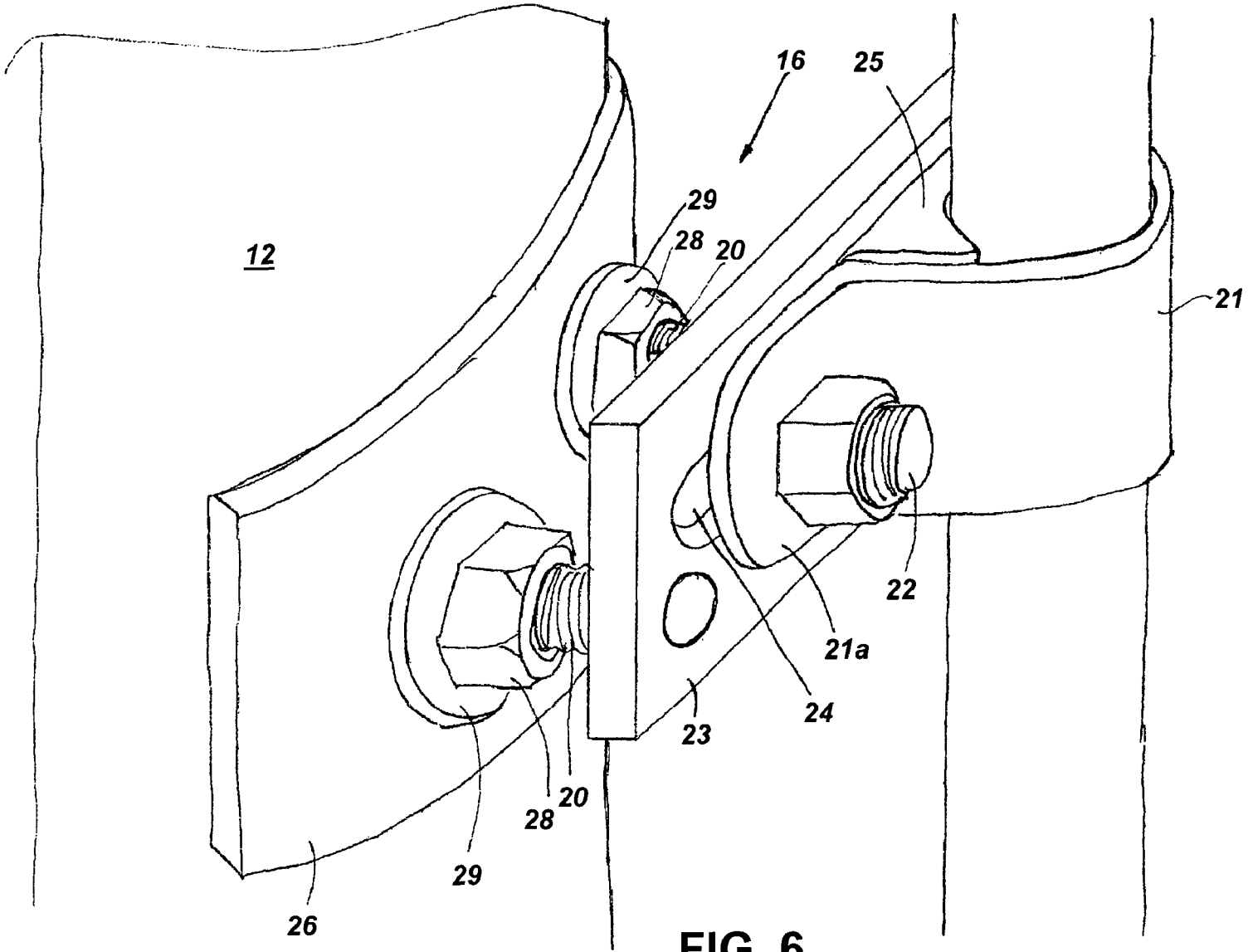
FIG. 6 is an enlarged perspective view of the upper hinge element of FIG. 3 in use.

Referring to FIGS. 3, 4, and 6, the upper hinge element 16 is shown in detail.

The upper hinge element 16 has a pair of elongate rods 20 having an external thread formed thereon. The rods 20 are received within a pair of bores formed in the post 12 in a longitudinally adjustable manner, so as to extend beyond the post 12 at either ends thereof, as is shown in FIG. 1. A plate 23 is attached to a common end of the rods 20 adjacent an opening in the fence 13, such that the plate 23 extends substantially perpendicular to the rods 20. In the embodiment as shown, the rods 20 are welded to the plates 23 at their respective ends; however, other means of attachment, such as bolts and other mechanical attachment means, are also envisaged.

A mounting member in the form of a collar 21 is mounted to an outer surface of the plate 23, as is shown more clearly in FIG. 4. The collar 21 is substantially U-shaped and has a pair of substantially planar flanges 21*a* extending therefrom to facilitate mounting of the collar 21 to the plate 23. Each flange 21*a* has a hole formed therein through which a bolt 22 is received. The plate 23 has a pair of laterally extending slots 24 formed therein, such that the bolt 22 is able to pass through the plate 23 and flange 21*a*, to secure the collar 21 in position against the plate 23. The lateral slots 24 enable variation in the lateral position of the collar 21 on the surface of the plate 23.

As is shown in FIG. 6, the U-shaped configuration of the collar 21 enables the collar 21 to be received around an upright end support 15 of gate 14. To further secure the end support 15 in position within the collar 21, a retaining member 25 is inserted into the collar 21 between the plate 23 and the support 15. Tightening of the bolts 22 will result in the end support 15 being snugly gripped by the collar 21 and retaining member 25, such that the upper hinge element 16 is secured to the end support 15 of the gate 14 in the manner as shown in FIG. 1.

Referring to FIGS. 3 and 4, the upper hinge element 16 comprises a pair of plates 26 that are configured to be received on the rods 20. In a preferred form, the plates 26 are curved, however, the plates may be otherwise shaped to form a bend, angle or the like therein. The plates 26 each have a pair of holes (not shown) formed therethrough so as to be slidingly positionable along the rods 20 as desired. In a preferred form, each plate 26 has a concave inner surface 27 that is configured to be located flush with the surface of the post 12 when the upper hinge element 16 is positioned for use. In this regard, the plates 26 are arranged to be located on opposing sides of the post 12, as shown in FIG. 1.

Fastening members in the form of nuts 28 and washers 29 are provided on the rods 20 so as to secure the plates 26 to opposing sides of the post 12. While the washers 29 are shown as standard planar washers, the washers may alternatively have a curved or wedge form so as to conform to the outer surface of the plates 26. It will be appreciated that tightening of the nuts 28 about the plates 26 applies a force against the plates 26 such that the plates 26 act to clamp against and around the post 12. While tightening of the nuts 28 and washers 29 against the surface of the plates 26 applies a force against the plates 26, such an arrangement also allows for greater tension to be placed on the nuts 28. This is particularly advantageous in comparison to prior art systems where the nuts 28 and washers 29 act directly against the surface of the post 12, as placing tension on the nuts 28 causes the nuts 28 and washes 29 to penetrate into the post 12 reducing the ability to fully tension the system. Further, in this arrangement, upon tightening of the nuts 28, the inner surface 27 of the plates 26 is located flush with the outer surface of the post 12, thereby forming a seal about the bores formed in the post 12 to act as a barrier against rain and the like accessing the bores and corroding the rods 20 and weakening the post 12.

It will be appreciated that the clamping nature of the plates 26 about the post 12 transfers the forces applied by the gate 14 to the upper hinge element 16 across a larger region of the post 12, and not merely along the interface between the rods 20 and the post 12. In this regard, when the gate 14 is in an open position and the weight of the gate 14 provides a pulling force against the upper hinge element 16, the pulling force is transferred about the post 12 rather than merely to the rods 20 extending through the post 12. Hence, the forces applied to the post 12 make the post 12 less inclined to split than is the case with conventional hinge elements. Further, the rods 20 are less likely to bend or buckle under load of the gate 14 as the forces are transferred more evenly to the post 12.

Figure 2:
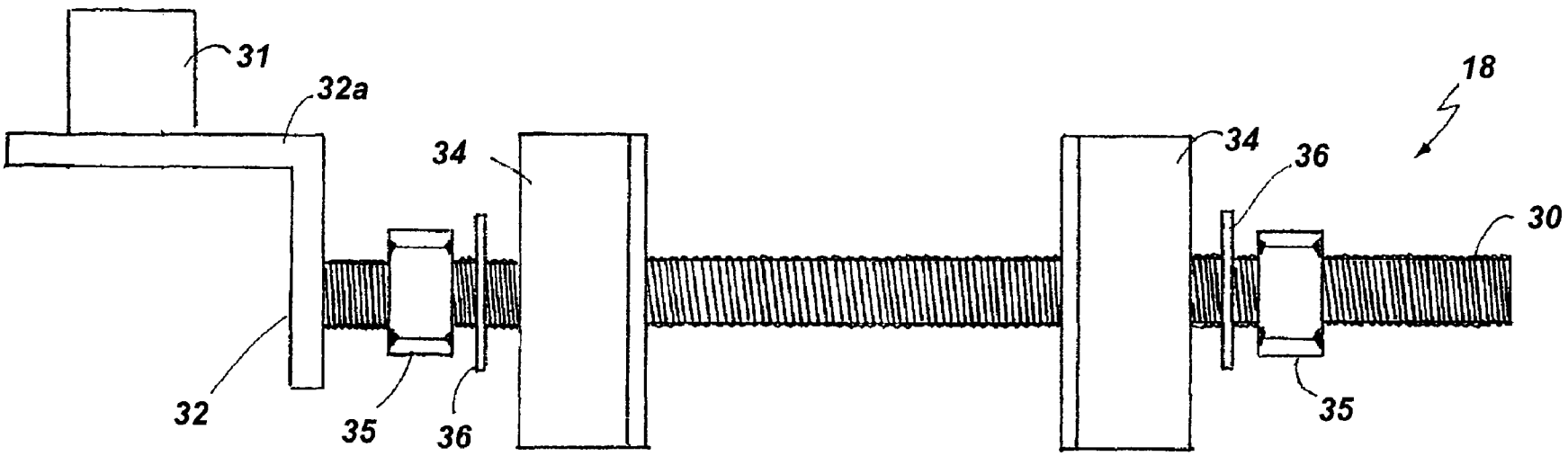
FIG. 2 is a side view of a lower hinge element of the gating system of FIG. 1, in accordance with one embodiment of the present invention.
Figure 5:
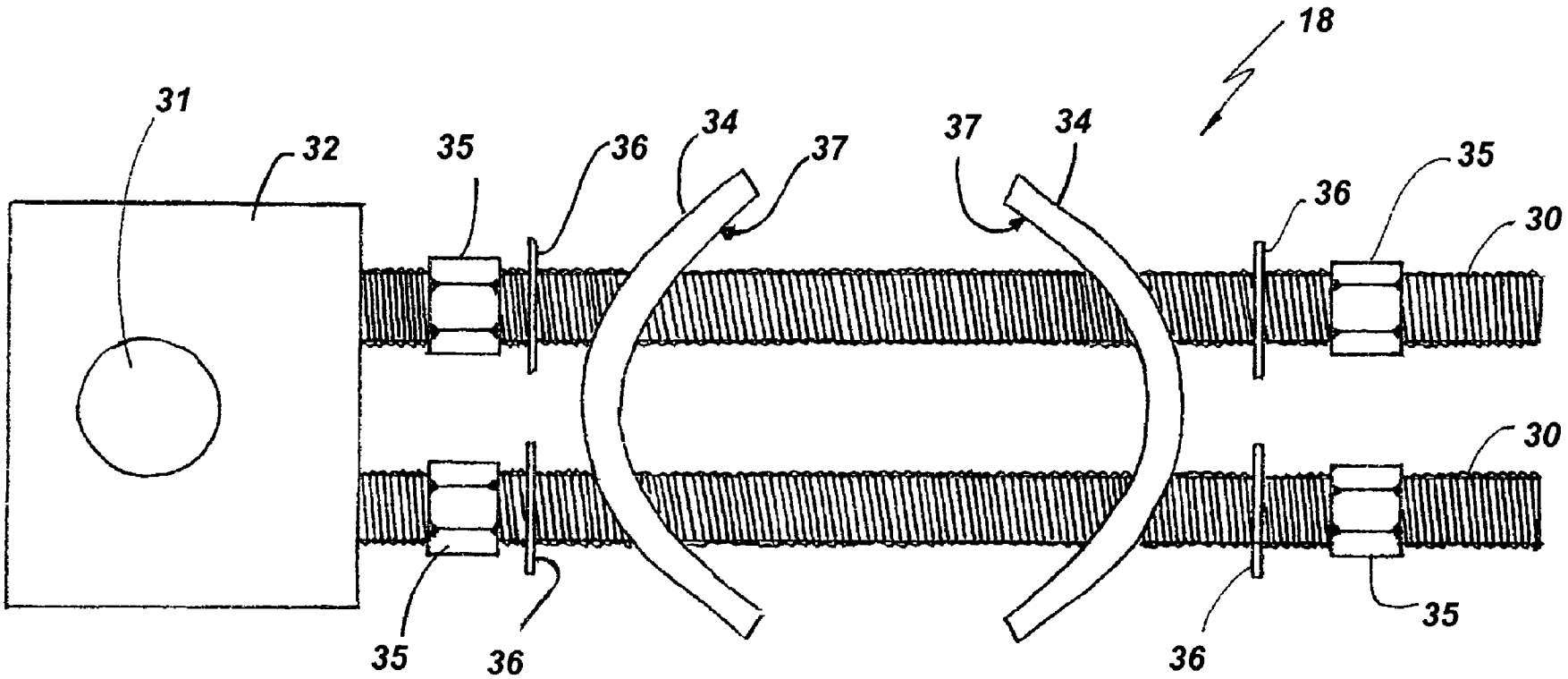
FIG. 5 is a top view of the lower hinge element of FIG. 2.
Figure 7:
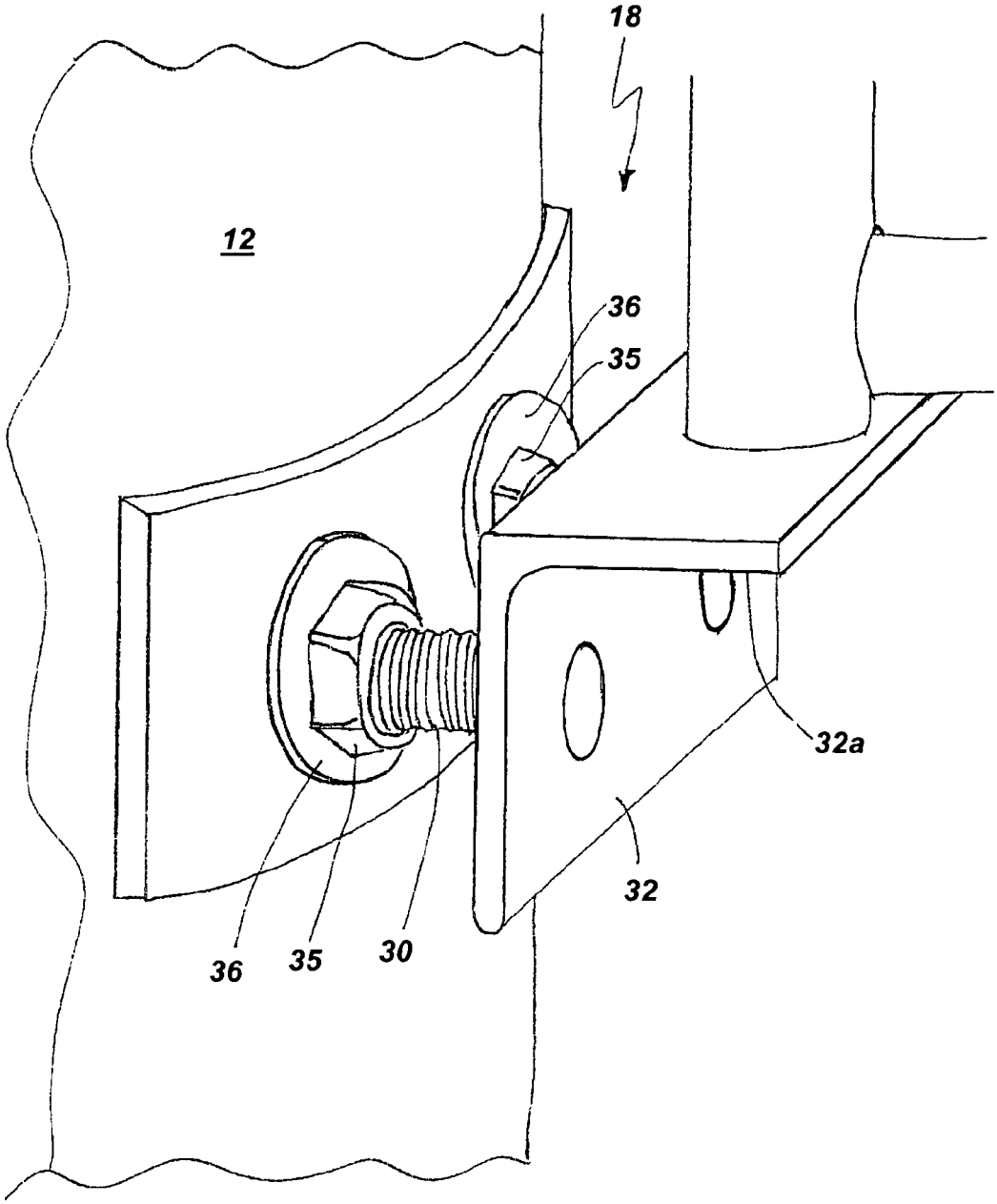
FIG. 7 is an enlarged perspective view of the lower hinge element of FIG. 2 in use.

Referring to FIGS. 2, 5 and 7, the lower hinge element 18 is shown in detail.

The lower hinge element 18 also comprises a pair of elongate rods 30 having an external thread formed thereon. The rods 30 are configured to be received in and to pass through a pair of bore holes formed in a lower region of the post 12, as described above in relation to the rods 20 of the upper hinge element 16. In such an arrangement, the opposing ends of the rods 30 project from the post 12 in a longitudinally adjustable manner, in the manner as shown in FIG. 1.

A mounting member in the form of an L-shaped bracket 32 is attached to a common end of the rods 30, namely, the end of the rods 30 adjacent an opening in the fence 13. The bracket 32 is orientated such that the vertical portion of the bracket 32 extends substantially perpendicular to the rods 30. The bracket 32 is secured to the ends of the rods 30 by way of welding; however, it will be appreciated that the bracket 32 may be attached to the ends of the rods 30 by way of a variety of fastening means, including nuts or other mechanical fastening devices. The L-shaped bracket 32 is secured to the ends of the rods 30 such that the horizontal portion 32*a* of the bracket 32 is positioned uppermost with respect to a ground surface, as shown in FIG. 1.

A mount 31, in the form of a pintle, extends from an upper surface of the horizontal portion 32*a* of the bracket 32. In this arrangement, the mount 31 projects upwardly with respect to the bracket 32 so to be received within an opening or gudgeon provided in the bottom of the tubular end support 15 of the gate 14. The gate 14 is then seated on the horizontal portion 32*a* of the bracket 32 and is located in position thereon by the mount 31, to facilitate swinging or pivotal movement of the gate 14 with respect to the post 12. Such an arrangement allows full swing of the gate 14 on the horizontal portion 32*a* of the bracket 32 without the gate coming into contact with the post 12 or the vertical portion of the bracket 32 during use.

Referring to FIGS. 2 and 5, the lower hinge element 18 also comprises a pair of plates 34 that are configured to be received on the rods 30. In a preferred form, the plates 34 are curved; however, the plates may be otherwise shaped to form a bend, angle or the like therein. The plates 34 each have a pair of holes (not shown) formed therethrough so as to be slidingly positionable along the rods 30 as desired. In a preferred form, each plate 34 has a concave inner surface 37 that is configured to be located flush with the surface of the post 12 when the lower hinge element 18 is positioned for use. In this regard, the plates 34 are arranged to be located on opposing sides of the post 12, as shown in FIG. 1.

Fastening members in the form of nuts 35 and washers 36 are provided on the rods 30 so as to secure the plates 34 to opposing sides of the post 12. While the washers 36 are shown as standard planar washers, the washers may alternatively have a curved or wedge form so as to conform to the outer surface of the plates 34. It will be appreciated that tightening of the nuts 35 about the plates 34 applies a force against the plates 34 such that the plates 34 act to clamp against and around the post 12. While tightening of the nuts 35 and washers 36 against the surface of the plates 34 applies a force against the plates 26, such an arrangement also allows for greater tension to be placed on the nuts 35. This is particularly advantageous in comparison to prior art systems where the nuts 35 and washers 36 act directly against the surface of the post 12, as placing tension on the nuts 35 causes the nuts 35 and washers 36 to penetrate into the post 12 reducing the ability to fully tension the system. In this arrangement, upon tightening of the nuts 35, the inner surface 37 of the plates 34 is located flush with the outer surface of the post 12, thereby forming a seal about the bores formed in the post 12 to act as a barrier against rain and the like accessing the bores and corroding the rods 30, and weakening the post 12.

It will be appreciated that the clamping nature of the plates 34 about the post 12 transfers the forces applied by the gate 14 to the lower hinge element 18, across a larger region of the post 12, and not merely at the interface between the rods 30 and the post 12. In this regard, when the gate 14 is in an open position and the weight of the gate 14 provides a pushing force against the lower hinge element 18, the pulling force is transferred about the post 12 rather than merely to the rods 30 extending through the post 12. Hence, the forces applied to the post 12 make the post 12 less inclined to split, than is the case with conventional hinge elements. Further, the rods 30 are less likely to bend or buckle under load of the gate 14 as the forces are transferred more evenly to the post 12.

The curved plates 26, 34 described above are preferably made from galvanized or coated steel and are formed to have a curve or arc having a diameter that substantially equates to the diameter of the post 12. In this regard, upon tightening of the upper and lower hinge elements 16, 18 about the post 12, the plates 26, 24 form a seal against the surface of the post 12.

Further, as the nuts 28, 35 and washers 29, 36 used to fasten the upper and lower hinge elements 16, 18 into position, act against the plates 26, 34 rather than the surface of the post 12, they do not penetrate into the soft post 12 when tightened, or under the weight of the gate 14, as is the case with existing hinge elements. With existing hinge elements, when the nuts and washers penetrate into the soft post 12, they act to further contribute to post splitting and are not accessible with a socket or spanner, thereby creating difficulties with adjusting the hinge elements should the need arise.

The arrangement of the upper hinge element 16 and the lower hinge element 18 more evenly distributes the forces of the gate 14 during use of the gate, thereby reducing the likelihood of the support post 12 splitting during use. The use of the plates 26, 34 to form a clamping action about the post 12 and the provision of more than one rod 20, 30 extending through the post 12, make the post and hinge elements function as one, greatly increasing the life of the gating system.

It will be appreciated that while each of the hinge elements 16, 18 are described above as comprising two rods 20, 30, the number of rods employed in each hinge element may vary. In particular, the provision of two or more rods 20, 30 for each hinge element reduces the likelihood of the rods 20, 30 bending or buckling under load of the gate 14, and any other forces applied to the gate 14, during use. While prior art systems, such as that disclosed in UK Patent Application No. GB 2193249, have employed a single shaft that extends through the post for mounting the hinge element to the post, with a shorter locating shaft extending in a U-shape from the single shaft so as to be received in a second locating recess formed in the post, such systems have been proposed to prevent the hinge element from loosening and rotating during use. In such systems, the single shaft extending through the post still experiences the majority of the force of the gate and is still found to bend or buckle under load. Further, such a system has been found to further contribute to post splitting as the single shaft and the locating shaft apply forces to the post in a manner that increases the likelihood of the post splitting in the vicinity of the bore and recess that accommodates the single shaft and the locating shaft accordingly.

The present invention provides a system that provides for greater interaction between the post and the hinge elements such that the components act as a single unit that combine to support the gate in position throughout use of the gate.

Orientational terms used in the specification and claims such as vertical, horizontal, top, bottom, upper and lower are to be interpreted as relational and are based on the premise that the component, item, article, apparatus, device or instrument will usually be considered in a particular orientation, typically with the hinge element uppermost.

It will be appreciated by those skilled in the art that many modifications and variations may be made to the methods of the invention described herein without departing from the spirit and scope of the invention.

What is claimed is:

1. A hinge element for pivotally mounting a gate to a fence post comprising:

a plurality of elongate rods, each rod being configured to be received within a corresponding bore formed through the post and being securable thereto in a longitudinally adjustable manner;

a mounting member attachable to an end of the elongate rods, the mounting member being configured to engage with at least a portion of the gate so as to facilitate pivotal movement of the gate with respect to the post; and two plates mounted on the rods, each of the two plates being positionable so as to abut with a surface of the post when the rods are secured to the post and having a concave surface configured to substantially conform to the surface of the post.

2. A hinge element according to claim 1, wherein the two plates are each mounted on the rods such that each of the rods passes through each of the two plates.

3. A hinge element according to claim 1, wherein the two plates are positionable to abut with the surface of the post on opposing sides of the post so as to function as a clamp at least partially about the post.

4. A hinge element according to claim 3, wherein each rod has an external thread formed at least partially along a length thereof for receiving a plurality of fastening members thereon, and wherein the rods are configured to be secured to a post by tightening the fastening members against opposing sides of the post.

5. A hinge element according to claim 4, wherein the plates are mounted on the rods so as to be between the fastening members and the post such that tightening of the fastening members against opposing sides of the post causes the plates to apply a clamping force against the post.

6. A hinge element according to claim 1, wherein the mounting member is a collar that is configured to be secured about an upper portion of the gate.

7. A hinge element according to claim 6, wherein the collar is movable laterally with respect to the post to facilitate lateral adjustment of the gate with respect to the post.

8. A hinge element according to claim 1, wherein the mounting member is a bracket having a pintle projecting from a surface thereof.

9. A hinge element for pivotally mounting a gate to a fence post comprising:

a plurality of elongate rods, each rod being configured to be received within a corresponding bore formed through the post;

a mounting element attachable to an end of the elongate rods, the mounting element being configured to engage with at least a portion of the gate so as to facilitate pivotal movement of the gate with respect to the post; and an engagement means mountable to the plurality of rods and actuable to secure the rods to the post in a longitudinally adjustable manner, the engagement means comprising a pair of curved plate members positionable on opposing sides of the post so as to abut with a surface of the post and a plurality of fastening members actuable to apply a force against the plate members such that the plate members apply a clamping action to the post.

10. A hinge element according to claim 9, wherein the elongate rods have an externally threaded portion provided substantially along the length thereof and the fastening members are internally threaded nuts mountable on the externally threaded portion at adjustable positions along the length thereof.

11. A hinge element according to claim 10, wherein the internally threaded nuts are actuable against the curved plate members on opposing sides of the post for securing the elongate rods within the corresponding bore in said longitudinally adjustable manner.

12. A mounting assembly comprising:

a gate;

a post;

an upper hinge element for securing an upper portion of the gate to the post, the upper hinge element comprising a plurality of first elongate rods, each first rod being configured to be received within a corresponding bore formed through the post and being securable thereto in a longitudinally adjustable manner; a collar attachable to an end of the first elongate rods, the collar being configured to be secured about an upper portion of the gate so as to facilitate pivotal movement of the upper portion of the gate with respect to the post; and at least one first curved plate mounted on the first rods, the at least one first curved plate being positionable so as to abut with a surface of the post when the first rods are secured to the post; and a lower hinge element for securing a lower portion of the gate to the post; the lower hinge element comprising a plurality of second elongate rods, each second rod being configured to be received within a corresponding bore formed through the post and being securable thereto in a longitudinally adjustable manner; a bracket having a pintle projecting from a surface thereof attachable to an end of the second elongate rods, the bracket being configured such that the pintle is received within a recess formed in an undersurface of the gate such that the gate is supported on the bracket and is free to pivot about the pintle to facilitate pivotal movement of the gate with respect to the post; and at least one second curved plate mounted on the second rods, the or each at least one second curved plate being positionable so as to abut with a surface of the post when the second rods are secured to the post.

13. A hinge element for mounting a gate to a post, the hinge element comprising:

a plurality of elongate rods, each rod configured to be received within a corresponding bore formed through the post and securable thereto in a longitudinally adjustable manner;

a mounting member attachable to an end of the elongate rods, the mounting member configured to pivotally engage at least a portion of the gate; and at least one bracket defining a plurality of voids therethrough and configured to abut a surface of the post when the rods are secured to the post through the bracket, wherein the at least one bracket comprises two plates configured to abut the surface of the post on opposing sides of the post so as to function as a clamp at least partially about the post.

14. The hinge element of claim 13, further comprising a plurality of fastening members, each disposed on one of the elongate rods between one of the plates and the post such that tightening of the fastening members causes the plates to apply a clamping force against the post.

* * * * *